US007052211B1

(12) United States Patent
Curry

(10) Patent No.: US 7,052,211 B1
(45) Date of Patent: May 30, 2006

(54) BUOYANCY COMPENSATING DEVICE PROTECTIVE COVER

(76) Inventor: Michael B. Curry, 3690 SW. 52nd Ter., Ocala, FL (US) 34474

( * ) Notice: Subject to any disclaimer, the term of this patent is extended or adjusted under 35 U.S.C. 154(b) by 0 days.

(21) Appl. No.: 11/122,876

(22) Filed: May 6, 2005

(51) Int. Cl.
*B63C 11/02* (2006.01)

(52) U.S. Cl. ..... 405/186; 441/106; 441/108

(58) Field of Classification Search ..... 405/186; 441/106–119; 2/2.15, 81, 97, 103
See application file for complete search history.

(56) References Cited

U.S. PATENT DOCUMENTS 3,360,814 A * 1/1968 Scheurer ..... 441/112
5,011,334 A * 4/1991 Vorhauer ..... 405/186
5,953,750 A * 9/1999 Stella ..... 2/2.15
6,592,298 B1 * 7/2003 Beltrani ..... 405/186
2004/0181843 A1 * 9/2004 Grilliot et al. ..... 2/81

* cited by examiner

*Primary Examiner*—Patricia L. Engle
*Assistant Examiner*—Gilbert Lee
(74) *Attorney, Agent, or Firm*—Sven W. Hanson

(57) ABSTRACT

A flexible protective cover is configured to be removably attached to the external outward-facing surfaces of a personal buoyancy compensating device (BCD). The BCD cover is preferably formed of a single layer of water resistant coated fabric or similar flexible and durable materials. The perimeter of the cover includes securing devices such as a zipper or hook-and-loop fasteners configured to retain the perimeter of the cover to the BCD. The attachment devices may include elements that are permanently secured to the BCD such as one half of a zipper device. In optional configurations, the BCD cover includes ancillary elements such as weight pockets and equipment attachment devices. The BCD cover may be configured to be installed onto existing prior BCDs.

4 Claims, 4 Drawing Sheets

BUOYANCY COMPENSATING DEVICE PROTECTIVE COVER

BACKGROUND OF THE INVENTION

The present invention pertains to personal buoyancy compensating devices (BCDs) used in conjunction with SCUBA dive equipment for underwater travel. In particular, the present invention is a removable cover attachable to, and covering the outside of, a flexible vest or jacket style BCD designed to be worn on the upper torso of a user. The cover functions to protect the outside of the BCD—and its air bladder or cell—from damage from the physical environment.

BCDs were developed as a means of easily and comfortably adjusting a diver's buoyancy in the water. Neutral buoyancy, or positive or negative buoyancy may be desired during the various activities of a single excursion in the water. Normal use of a diver's air supply may affect buoyancy such that adjustment of buoyancy is needed and desired. To control the volume of retained air, a BCD includes a device for inflating with air and a valve for deflating the BCD. Together with physical weights, the BCD is a standard device and method by which buoyancy adjustment is typically accomplished. In addition, a BCD may serve as a safety device—providing a surface float for a diver.

Most early BCDs were formed of an inflatable bladder captured within a separate flexible bag or envelope. The bladder provided a means of retaining a volume of air and the envelope provided protection to the bladder and means of attachment to other equipment and to the diver's body. Most currently popular vest and jacket styled BCDs are formed of a single similar air-retaining envelope. As such, they are not considered to have a separate bladder and therefore most current vest and jacket styled BCDs are known as "bladderless" devices or products. The bladderless BCD is typically formed of two separate layers of relative tough yet flexible rubber or plastic impregnated or covered fabric that are cojoined at their perimeters to create an airtight envelope. This envelope is then filled as needed in use with a quantity of air for buoyancy adjustment. The vest or jacket styled BCD is typically configured to have a flexible body-conforming construction and shape for optimum distribution of the buoyant force of the contained air, and for comfort.

A significant number of sport and recreational divers dive in ship wrecks and underwater caves. However, these locations pose increased risks to both divers and their equipment. A diver traveling through the structure of a submerged ship or a cave, or other potentially hazardous area, may incur abrasion or even puncture of a BCD. With current bladderless BCDs, such a violation of the bladder may render the BCD inoperable, or worse, create a dangerous negative buoyancy condition due to loss of balancing air volume. These types of risks are even more prevalent in the work environments of many commercial and industrial divers and also public service divers such as fire department and similar municipal rescue divers. This risk from potential BCD damage is due, at least in part, to the relatively low strength and toughness of the flexible materials use in construction of jacket styled BCDs.

What is needed is a means of adding to a BCD, particularly flexible bladderless jacket styled BCDs, an external covering that can protect against damage from physical contact by surrounding objects.

SUMMARY OF THE INVENTION

The present invention is a tough yet flexible covering configured to be removably attached to a flexible vest or jacket styled BCD. The inventive cover is oriented on the BCD to protect the external outward-facing surfaces of the BCD. The inventive cover is removable to allow the user's associated BCD to be used without the added bulk, complexity and weight of the inventive cover, when protection from physical damage is not needed.

The BCD cover includes a cover body preferably formed of a flexible sheet layer. The cover body may be formed of any of a variety of materials, most preferably of a single sheet of a rubber or plastic coated fabric. The perimeter of the cover body includes attachment devices such as a zipper or hook-and-loop fasteners configured to releasably secure substantially the entire perimeter of the cover body to a BCD. The attachment devices may have elements that are permanently secured to the BCD such as one half of a zipper device. In an alternative configuration, the attachment device consists of multiple sleeve elements through which BCD shoulder and waist elements may pass and be retained to secure the cover to the BCD.

Optionally, the BCD cover may include ancillary elements such as weight pockets and equipment attachment devices.

In preferred embodiments, the inventive BCD cover is configured to be installable onto prior BCDs. The present invention also includes methods of increasing the durability of bladderless BCDs by attaching the inventive BCD cover to an exposed surface of the BCD.

DESCRIPTION OF THE PREFERRED EMBODIMENTS

Figure 1:
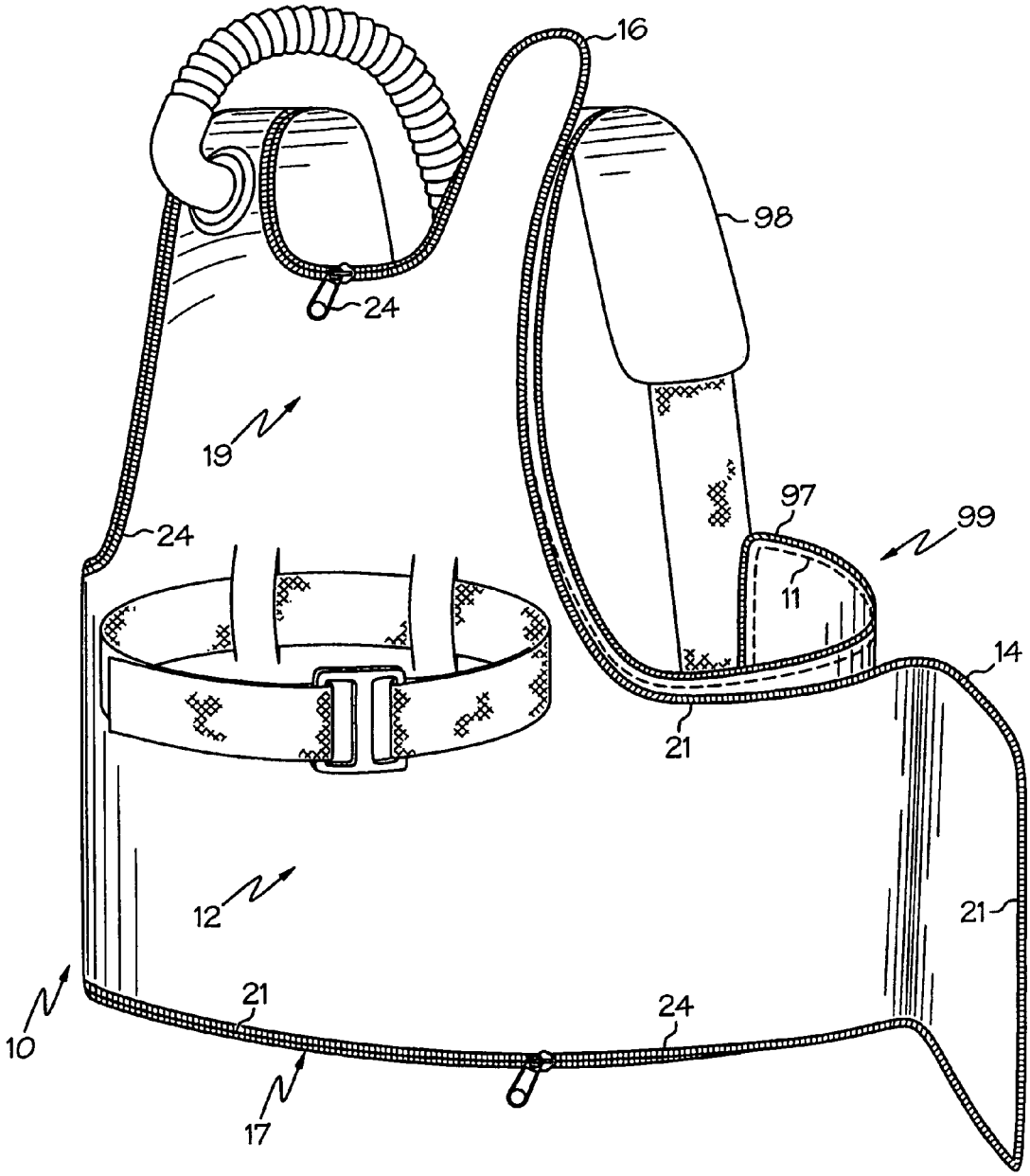
FIG. 1 is a perspective figure of one embodiment of the invention. The device is viewed from a back or posterior relative orientation.
Figure 2:
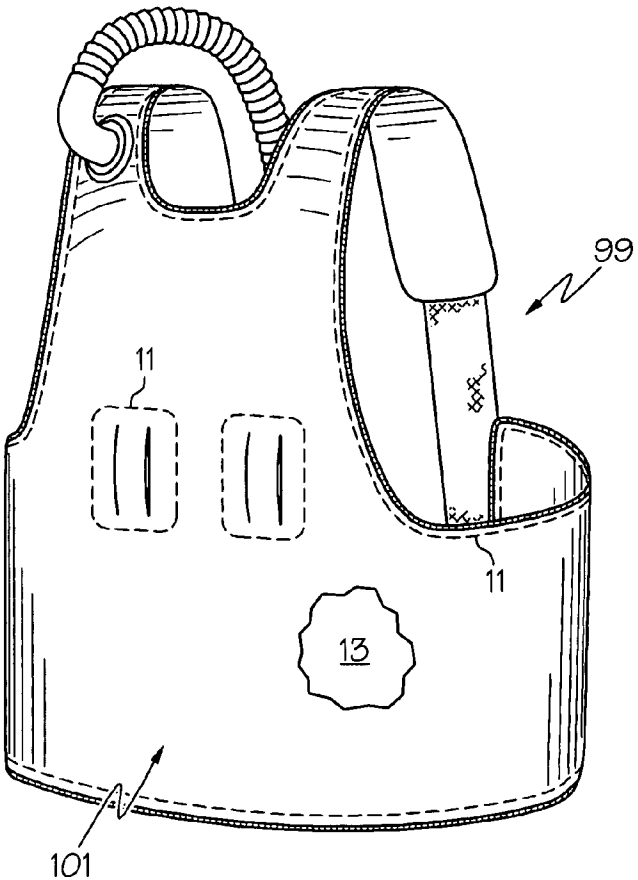
FIG. 2 is a second view of the embodiment of FIG. 1 in which the inventive cover is shown separated from a BCD to view an exposed exterior surface of the BCD.
Figure 2:
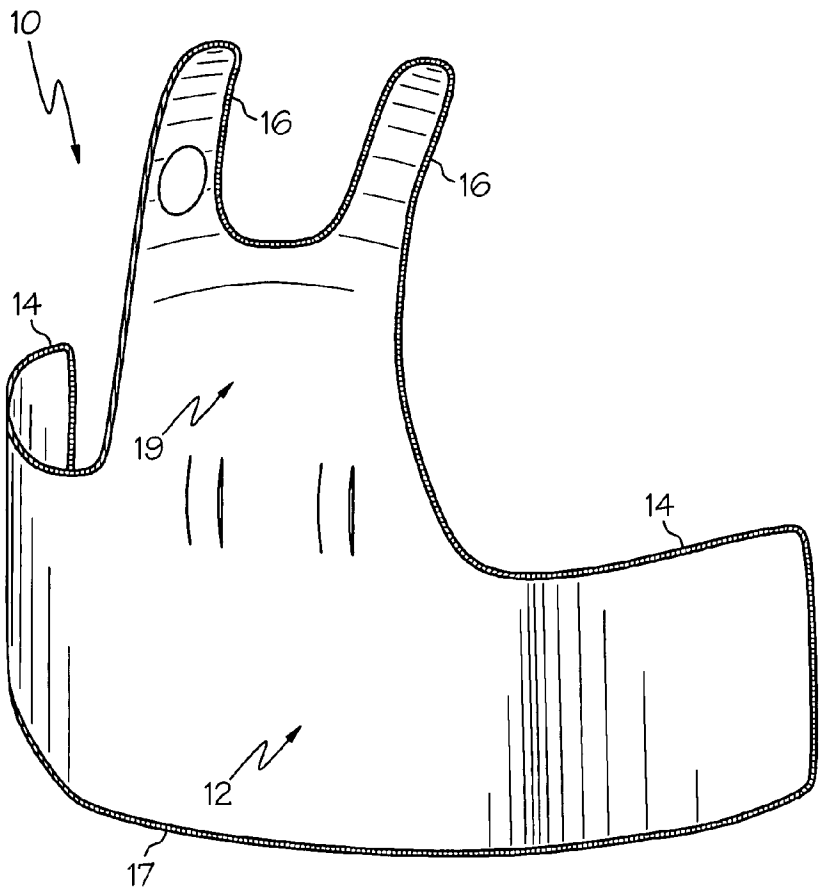

FIGS. 1 and 2 depict two views of a preferred embodiment of the invention. In FIG. 1, an inventive cover 10 is viewed from the back or posterior aspect of a buoyancy compensating device (BCD) 99, relative to its normal use position on a user. Herein, the terms "back" and "posterior" are used relative to an orientation respecting a user wearing the device in the normal manner, the terms indicating the dorsal, back, or posterior aspect of the user's body. In FIG. 2, the same cover 10 is shown separated from the BCD to better depict the mating surfaces of the BCD. The following discussion regards both figures. The BCD shown is a flexible jacket style typical of many prior art devices. The body of the BCD is generally constructed of two layers of rubber or plastic coated fabric that are cojoined at air-tight seams 11 at their perimeter to form an air retaining envelope 13. These seams are typically formed by known methods of RF (radio frequency) contact welding of the facing layers. Jacket styled BCDs of other constructions are also applicable. The general shape of the BCD shown is that of a jacket or vest with shoulder straps 98 and waist portions 97 to conformingly retain the BCD to the user's body. The waist portions typically extend circumferentially from the back, at or above the user's hip level, toward the user's front, and typically include closure devices for securing the opposing waist portions to encircle the user. This configuration is typical in BCDs but can vary in details, in particular in the form and shape of the seams, shoulder straps, and waist portions, that can be enlarged or smaller or even absent in alternative BCD designs. In general, various areas or portions of the BCD, including regions in the waist and shoulders may include portions of the BCD air retaining envelope 13. Therefore, all of these areas are presumed to benefit from additional protection from contact against external objects. In FIGS. 1 and 2, the BCD is depicted as relatively flat in form for simplicity. Actual BCDs have more bulk due to the thickness of their materials of construction and the inherently present retained air.

The cover 10 is comprised of a central portion 12 from which extend two waist portion flaps 14 and two shoulder flaps 16. The left waist flap in FIG. 1 cannot be seen as it curves around the far side of the BCD in this view. The central portion 12 overlays the posterior outwardly facing portion 101 of the BCD (see FIG. 2) and provides protection there.

The term "outwardly" and similar spatial terms such as "top" and "bottom" are used with relative to a user on which the covered BCD is worn in normal fashion, "bottom" being associated generally with the relative direction of the user's feet. In particular, "outward" and other forms of the word indicate an aspect or direction away from the user's body and exposed to the outside or external environment separated from the user. In contrast, "inward" and "inside" indicates an object or surface directed toward and particularly against the user's body when the BCD is worn and in use.

The cover central portion 12 is the core element of the cover as the posterior outwardly facing portion 101 of the BCD is out of the field of view of the user during use and therefore is most susceptible to contact with, and damage from, the user's surrounding environment. The central portion 12 may have various shapes in different configurations, in all cases corresponding to the shape of the respective BCD posterior regions to be covered—generally sized for covering the back of a human body upper torso. The bottom edge 17 of the central portion 12 preferably extends fully to the respective bottom edge of the BCD to provide maximum protection. A top portion 19 of the central portion 12 and the shoulder flaps 16 preferably extend at least sufficient to overlay the upper most extent of the air-containing envelope of the particular BCD. In some BCDs, the air envelope may not extend into the shoulder portions of the BCD. In such cases, the cover 10 may omit shoulder flaps 16.

The two waist flaps 14 extend from opposite sides of the central portion 12, in opposite directions, to overlay the BCD waist portion. The length (circumferential with respect to a user) and vertical width of each waist flap 14 are each dependent upon the dimensions of the particular BCD for which the cover is designed, which in turn are dependent at least on the dimensions of the intended user. Optionally, the waist flaps may be truncated or eliminated (see below regarding FIG. 3). Such a cover may be used, for example, in conjunction with a bladderless BCD that does not have air containment in a waist portion. As well, even with BCDs having an inflatable waist portion, integrated pockets or other elements on the BCD providing additional covering and protection in the waist portion may reduce the need for separate protection and covering.

The shoulder flaps 16 are located between the waist flaps 14, and each shoulder strap 16 extends upward from the top of the central portion 12, preferably to sufficient length that they may extend over the ridge of a user's shoulder. In this way, the leading edge of the shoulder flaps 16 are less likely to be snagged by elements in the user's surroundings during forward movement. The required length varies with the particular BCD size.

A cover as described herein adds weight, bulk and complexity to a jacket-style BCD. A user may have periodic or occasional need for the benefits of a protective cover, but may prefer, at other times, to use an uncovered BCD. Rather than have available multiple BCDs to provide these multiple uses, it is desirable to apply a protective cover to a single BCD only at those times when particularly needed. Consequently, when the added protection of the cover is not needed by the user, means of removing the cover is necessary. The cover 10 is removably attached to the BCD 99 by securing means that secures substantially the entire perimeter 21 of the cover 10 to the BCD. As well as for retaining the cover 10 in position, the securing means ensures that the cover 10, at the perimeter, does not present any protrusion that might snag on external objects or slow the user by inducing drag to water flow around the user. For this reason, widely spaced point attachment devices are undesirable as a securing means.

In the embodiment shown in FIGS. 1 and 2, the securing means is one or more lengths of zipper 24, the mating portions of which are attached to or integral to the cover 10 and BCD 99, respectively. While in the figures, the zipper 24 is shown continuous around the perimeter 21, it may be acceptable to have short gaps between adjacent lengths of zipper to accommodate the zipper end elements. So long as these gaps are not sufficient to allow the cover 10 to separate from the BCD, the securing is considered substantially continuous and effective for the purposes of the inventive cover. To some degree, allowable gaps may be dependent upon the stiffness of the material used to form the cover 10 (see below). Such gaps may also provide for drainage of water from between the BCD 99 and the cover 10. In the figures, the zipper is shown extending from the extreme edge of the BCD, but more accurately and preferably, the zipper is sown, or otherwise attached, adjacent and close to the BCD perimeter edge, but laying against the external surface of the BCD. The particular methods of attaching a zipper to the material of the BCD and cover to effect the desired construction and function is known to those practiced in manufacture of BCDs.

Other less preferable devices and constructions for providing the securing means are also contemplated. In one alternative, mating hook-and-loop fastening elements are attached to the cover 10 and BCD 99 at their perimeters in the general location of the zipper 24 shown in the figures. To simplify construction, hook-and-loop fasteners may be used in short spans, between, and in combination with, multiple lengths of zipper. The securing means may also take the form of snaps as long as very short center-to-center distances are used. However, such a construction is not preferred as such a construction creates greater risk of snagging due to the open spaces between snaps.

The principal function of the inventive cover 10 is to protect the BCD by providing a physical barrier between the BCD and potentially damaging external structures. The cover 10 is preferably constructed of a single layer of rubber or plastic impregnated or coated fabric sheet. The desired properties in cover materials are toughness and durability, chemical stability with respect to salt water, and flexibility. As well, a closed construction that retains minimal water, such as is provided by most coated fabrics, is preferred. Many sheet materials such as are typically used in construction of BCDs are appropriate. Solid plastic sheets such as high density polyethylene may also possibly be used, but they are not preferred as they may lack the conformability of the more flexible fabric-based materials. Heavy-weight uncoated fabrics and mesh materials may also provide the desired durability and toughness. Non-fabric based flexible materials having elastic properties, such as closed cell rubber sheet material may also be used. Other flexible sheet materials having similar properties as those above as also contemplated.

The cover 10 is preferably formed of a single sheet of material without three-dimensional contouring. The preferred cover 10, when removed from a BCD, should be capable of being laid flat and tightly rolled upon itself. As shown in the figures, the cover 10 may include centrally located slits to accommodate tank straps, or holes to accommodate BCD mounted elements or appliances such as an air hose or overpressure valve. Drain holes are preferably provided at lower margins of the cover 10 to allow draining of any captured water. Pockets and other accessories as are found on BCDs may also be integrated to the outside of the cover 10. Alternatively, multiple plies or layers of one or more flexible sheet materials may be combined to provide the required toughness and other properties.

Figure 3:
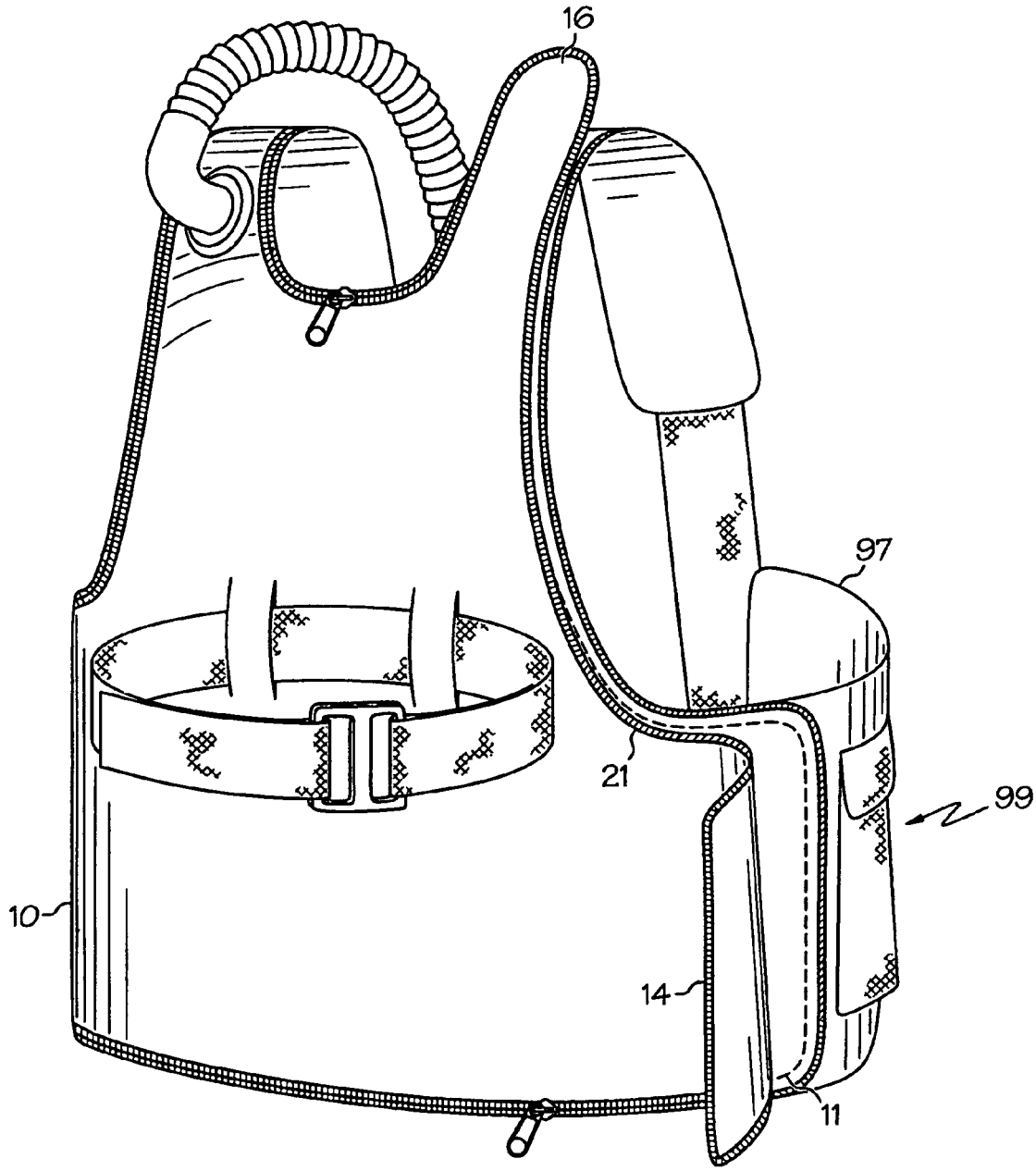
FIG. 3 is a perspective view of an alternative shape of the inventive cover with shortened waist flaps. The device is viewed from the back or posterior relative to normal use.

FIG. 3 depicts an alternative configuration of the inventive cover 10 on a typical BCD. In this configuration, the cover 10 waist flaps 14 are shortened such that the BCD waist portions 97 are not covered. Such a configuration may be beneficial or preferred to that of FIG. 1, if the BCD includes essential accessories that would be otherwise obscured by longer cover waist flaps or if the BCD includes a partial cover to allow pockets or other components to be attached to the BCD. Similarly, in other alternative configurations, the shoulder flaps 16 may be shortened, or eliminated, in like manner.

Figure 4:
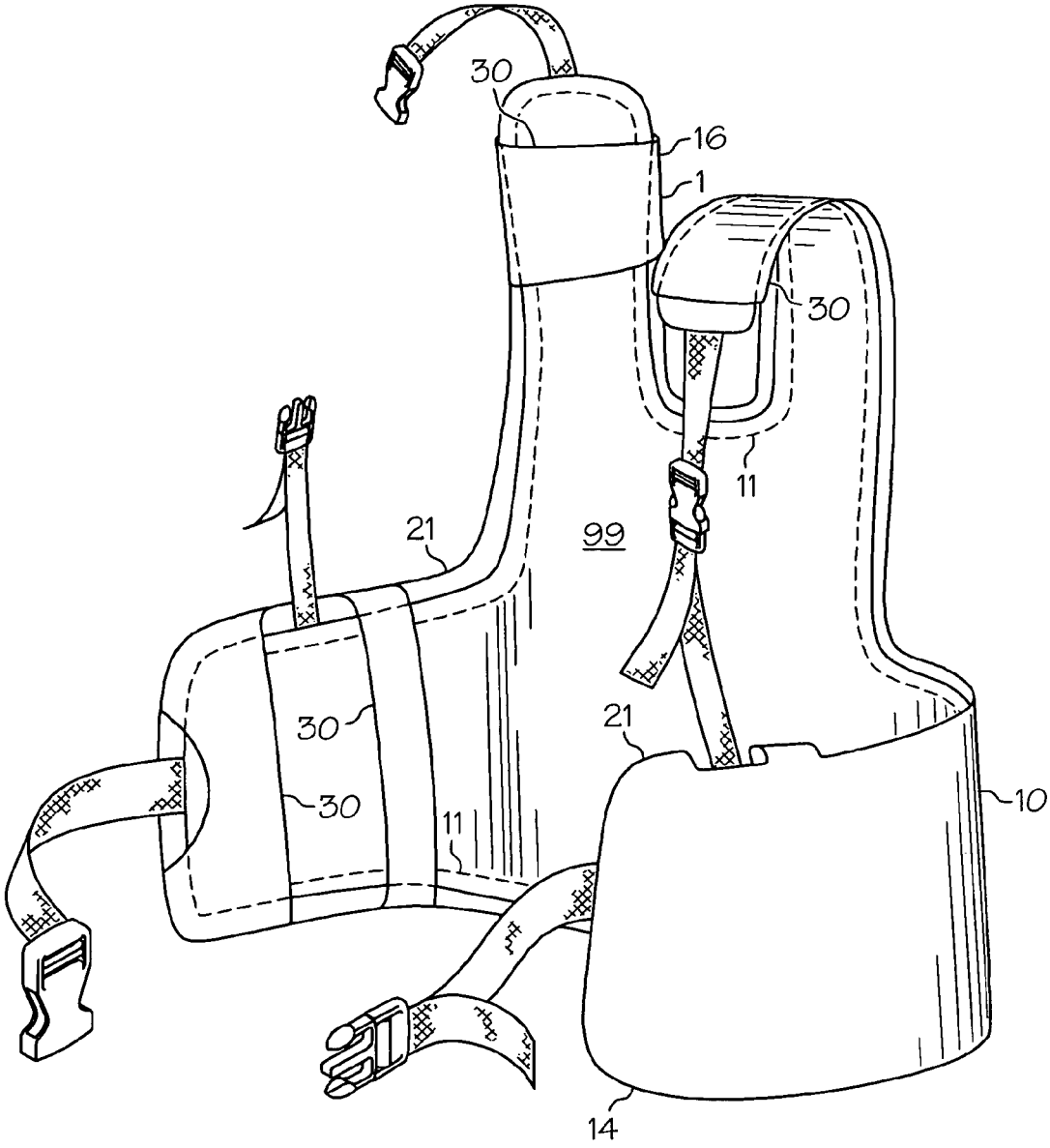
FIG. 4 is perspective view an alternative embodiment of the invention illustrating the use of sleeve elements as a securing device to a BCD. The BCD is viewed from a front or anterior orientation.

FIG. 4 illustrates a cover 10 according to the invention in which the securing means has the form of sleeve elements 30. Each sleeve element 30 is a sheet portion secured, at least at opposing ends, to two separated lengths of the cover perimeter 21 to form a closed sleeve-like loop. The sleeve elements are provided on the shoulder flaps 16 and waist flaps 14 such as to allow a BCD's shoulder straps and waist bands to be passed through the sleeve elements 30 thereby capturing and retaining the BCD to the cover 10. With such a construction, the cover material should be sufficiently stiff to prevent the cover 10 from separating greatly from the BCD between the sleeve elements. Separation may also be reduced by tension induced in the cover 10 by a tight fit with the BCD.

While the present inventive cover 10 may be employed with a BCD having a bladder and exterior cover, the present invention provides the greatest benefit with bladder-less type BCDs. The invention includes an improvement to prior art BCDs in the form of a removable cover as described above. The invention is also methods by which a BCD may be protected by incorporation of the novel cover as described.

The preceding discussion is provided for example only. Other variations of the claimed inventive concepts will be obvious to those skilled in the art. Adaptation or incorporation of known alternative devices and materials, present and future is also contemplated. The intended scope of the invention is defined by the following claims.

The invention claimed is:

1. A personal buoyancy compensating device having increased protection from damage from contact with external objects, comprising:

a flexible jacket-style buoyancy compensating device body having a exterior surface posterior region;

a flexible sheet body having a perimeter and configured to be secured over at least the posterior region; and securing means for removably securing the perimeter to the buoyancy compensating device such that the sheet body covers the posterior region.

2. A personal buoyancy compensating device, according to claim 1, and wherein:

the personal buoyancy compensating device body has waist portions and shoulder straps; and the sheet body has waist flaps configured to overlay the waist portions, and shoulder flaps configured to overlay the shoulder straps.

3. A personal buoyancy compensating device, according to claim 1, and wherein:

the securing means comprises at least one length of zipper.

4. A personal buoyancy compensating device, BCD, having increased protection from damage from contact with external objects, comprising:

a flexible buoyancy compensating device having at least one air storage envelope region;

a flexible sheet covering the air storage regions and having a perimeter;

a separable securing device attached to the buoyance compensating device and the perimeter; such that when separated, the sheet is removable from the BCD;

and wherein:

the buoyancy compensating device includes a posterior portion and two waist portions extending from the posterior portion; and wherein the at least one air storage region extends within the posterior portion and the waist portions.

* * * * *